US011808084B2

(12) United States Patent
Marsden

(10) Patent No.: US 11,808,084 B2
(45) Date of Patent: Nov. 7, 2023

(54) GATE LATCH

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 351 days.

(21) Appl. No.: 17/161,600

(22) Filed: Jan. 28, 2021

(65) Prior Publication Data

US 2021/0238899 A1 Aug. 5, 2021

Related U.S. Application Data

(60) Provisional application No. 62/968,879, filed on Jan. 31, 2020.

(51) Int. Cl.

| | |
|---|---|
| ***E06B 9/04*** | (2006.01) |
| ***E05B 63/00*** | (2006.01) |
| ***E05B 65/00*** | (2006.01) |
| ***E05C 3/14*** | (2006.01) |
| ***E05D 7/04*** | (2006.01) |
| ***E06B 9/02*** | (2006.01) |

(52) U.S. Cl.

CPC ..... *E06B 9/04* (2013.01); *E05B 63/0056* (2013.01); *E05B 65/0007* (2013.01); *E05C 3/14* (2013.01); *E05D 7/04* (2013.01); *E06B 9/02* (2013.01); *E05B 65/0014* (2013.01)

(58) Field of Classification Search

CPC .. E06B 2009/002; E06B 9/04; E05B 63/0056; E05B 65/0007; E05B 65/0014; E05B 17/2088; E05C 3/14; E05D 7/04

See application file for complete search history.

(56) References Cited

U.S. PATENT DOCUMENTS

| | | | | |
|---|---|---|---|---|
| 1,127,825 | A | 2/1915 | Swank | |
| 2,542,696 | A | 2/1951 | Nelson | |
| 2,585,152 | A | 2/1952 | Merchant | |
| 4,083,591 | A * | 4/1978 | Parisien | E05B 65/06 292/202 |
| 5,138,796 | A | 8/1992 | Grainger | |
| D347,570 | S | 6/1994 | Burge | |
| 5,742,978 | A | 4/1998 | Vetter | |

(Continued)

FOREIGN PATENT DOCUMENTS

| | | |
|---|---|---|
| CN | 105178829 B | 2/2017 |
| GB | 2 268 210 A | 1/1994 |

OTHER PUBLICATIONS

[No. Author Listed] Regalo Top of Stairs Gate Installation (Model #1250). RegaloBaby YouTube Channel. https://www.youtube.com/watch?v=u46GzucNH_Y. Uploaded Sep. 19, 2019. 1 page.

(Continued)

*Primary Examiner* — Justin B Rephann

(74) *Attorney, Agent, or Firm* — Wolf, Greenfield & Sacks, P.C.

(57) ABSTRACT

Methods and apparatus for using a gate latch to selectively prevent the opening of a gate barrier. The gate latch includes a retainer assembly to selectively prevent a latch member attached to a gate barrier from moving sufficiently to allow the gate barrier to swing open. A swing blocker may be provided on the same latch as the retaining assembly so that the gate may be opened only in a first direction.

16 Claims, 9 Drawing Sheets

(56) References Cited

U.S. PATENT DOCUMENTS

| | | | | |
|---|---|---|---|---|
| D394,796 | S | 6/1998 | Alford et al. | |
| 5,797,218 | A | 8/1998 | Holland | |
| D402,181 | S | 12/1998 | Hayes | |
| 6,112,461 | A | 9/2000 | Cheng | |
| 6,516,568 | B2 | 2/2003 | Yang | |
| 6,715,182 | B2 | 4/2004 | Cheng | |
| 7,065,922 | B1 | 6/2006 | De Kruijf et al. | |
| D528,899 | S | 9/2006 | Bell et al. | |
| 7,147,213 | B1 | 12/2006 | Amendola | |
| 7,240,400 | B2 | 7/2007 | Bonham | |
| D553,950 | S | 10/2007 | Flory | |
| 7,291,300 | B2 | 10/2007 | Anderson et al. | |
| D554,973 | S | 11/2007 | Flory | |
| 7,373,755 | B2 | 5/2008 | Jefferys et al. | |
| D571,635 | S | 6/2008 | Liang et al. | |
| D595,564 | S | 7/2009 | Jones et al. | |
| 7,874,103 | B2 * | 1/2011 | Yates | E06B 9/04 49/226 |
| 7,926,539 | B1 | 4/2011 | Hurst et al. | |
| 8,136,302 | B2 | 3/2012 | Trujillo et al. | |
| 8,341,886 | B2 | 1/2013 | Yates | |
| 8,413,300 | B1 | 4/2013 | Luneborg | |
| 8,615,928 | B2 | 12/2013 | Wang | |
| D703,513 | S | 4/2014 | Mistyurik | |
| D712,233 | S | 9/2014 | Pittman | |
| D721,568 | S | 1/2015 | Cantwell et al. | |
| 9,022,359 | B2 | 5/2015 | McAlmond | |
| 9,097,050 | B2 | 8/2015 | Yates | |
| 9,366,075 | B2 | 6/2016 | Marsden et al. | |
| 9,394,726 | B1 | 7/2016 | Flannery et al. | |
| 9,677,310 | B1 | 6/2017 | Russo et al. | |
| 9,810,010 | B1 | 11/2017 | Woodard et al. | |
| 9,822,585 | B2 | 11/2017 | Flannery et al. | |
| D821,191 | S | 6/2018 | Hancock | |
| 10,024,080 | B2 * | 7/2018 | Marsden | E05B 41/00 |
| D829,091 | S | 9/2018 | Hancock | |
| 10,301,848 | B2 | 5/2019 | Diesing | |
| 10,415,290 | B1 | 9/2019 | Flannery et al. | |
| 10,550,634 | B1 * | 2/2020 | Holland | E06B 9/06 |
| 10,619,408 | B2 | 4/2020 | Sander | |
| 10,655,365 | B2 | 5/2020 | Benson et al. | |
| 10,683,699 | B2 * | 6/2020 | Wang | E06B 9/04 |
| 10,745,941 | B2 | 8/2020 | Fang et al. | |
| 10,907,404 | B1 * | 2/2021 | Flannery | E05D 15/58 |
| 10,934,768 | B2 * | 3/2021 | Flannery | E05C 3/045 |
| 10,975,621 | B2 | 4/2021 | Gentil | |
| 11,118,398 | B2 * | 9/2021 | Kaiser | E06B 9/04 |
| D933,451 | S | 10/2021 | Marsden | |
| D934,053 | S | 10/2021 | Marsden | |
| 11,149,488 | B2 * | 10/2021 | Wang | E06B 9/04 |
| D934,672 | S | 11/2021 | Marsden | |
| D934,673 | S | 11/2021 | Marsden | |
| D934,674 | S | 11/2021 | Marsden | |
| 2002/0007597 | A1 | 1/2002 | Wang | |
| 2003/0005643 | A1 | 1/2003 | Yang | |
| 2003/0009945 | A1 | 1/2003 | Cheng | |
| 2004/0045222 | A1 * | 3/2004 | Hicks | E06B 9/04 49/157 |
| 2007/0131921 | A1 * | 6/2007 | Monahan | E06B 9/04 256/73 |
| 2009/0013604 | A1 | 1/2009 | Yates | |
| 2009/0013606 | A1 | 1/2009 | Yates | |
| 2014/0007506 | A1 | 1/2014 | Huang | |
| 2015/0101253 | A1 * | 4/2015 | Marsden | E05B 63/0065 49/386 |
| 2017/0058595 | A1 * | 3/2017 | Marsden | E05B 41/00 |
| 2017/0073998 | A1 * | 3/2017 | Fang | E05B 65/0007 |
| 2017/0211314 | A1 * | 7/2017 | Raffi | E06B 9/04 |
| 2019/0136619 | A1 | 5/2019 | Flannery et al. | |
| 2021/0007485 | A1 | 1/2021 | Marsden | |

OTHER PUBLICATIONS

U.S. Appl. No. 18/139,200, filed Apr. 25, 2023, Marsden.
U.S. Appl. No. 18/139,210, filed Apr. 25, 2023, Marsden.
U.S. Appl. No. 29/836,867, filed Apr. 29, 2022, Marsden.
U.S. Appl. No. 29/836,912, filed Apr. 29, 2022, Marsden.

* cited by examiner

GATE LATCH

CROSS-REFERENCE TO RELATED APPLICATIONS

This application claims the benefit of priority under 35 U.S.C. § 119(e) of U.S. Provisional Patent Application Ser. No. 62/968,879, filed Jan. 31, 2020, and entitled "Gate Latch," the disclosure of which is incorporated herein by reference in its entirety.

FIELD

The disclosed embodiments generally relate to safety gates and more specifically to gate latch assemblies.

DESCRIPTION OF THE RELATED ART

Gate latches are known for helping secure a gate barrier in place yet permitting a user to open the barrier when desired. For example, a gate can be installed to help prevent a young child from accessing areas of a house, and a gate latch can be configured to allow an adult to perform one or more steps to open the gate barrier.

SUMMARY

According to one aspect of the disclosure, an apparatus includes a gate latch configured to prevent a gate barrier from opening in a first direction. The gate latch includes a base and an upper retainer to retain a latch member, with the upper retainer being movable to selectively retain the latch member in the gate latch and permit removal of the latch member from the gate latch. The gate latch also includes a lower retainer to retain the latch member and a blocker arranged to prevent the latch member from moving beyond the blocker in the first direction when the latch member is removed from the lower retainer. The base has a front-facing surface, and the upper retainer has a rear-facing surface, which faces the front-facing surface of the base. The front-facing surface of the base is spaced from the rear-facing surface of the upper retainer by a first distance. The blocker extends forwardly beyond the front-facing surface of the base by a second distance, which is less than or equal to the first distance.

According to another aspect of the disclosure, an apparatus includes a latch member and a gate latch configured to prevent a gate barrier from opening in a first direction. The gate latch includes a base and an upper retainer for a latch member, with the upper retainer being movable to selectively retain the latch member. The upper retainer has a rear-facing surface. The gate latch also includes a lower retainer for the latch member and a blocker arranged to prevent the latch member from moving beyond the blocker in the first direction, the blocker including a portion arranged to be contacted by the latch member. The blocker is positioned to permit at least a portion of the upper retainer to move beyond the blocker portion with the rear-facing surface of the upper retainer facing the blocker portion.

According to a further aspect of the disclosure, a method includes selecting a direction in which a gate barrier of a gate is prevented from opening as part of installing the gate. The gate includes a gate latch. The gate latch includes a latch member, a lower retainer, and a movable upper retainer. The movable upper retainer selectively holds the latch member within the lower retainer. The method further includes selecting a barrier swing direction in which the gate barrier will be prevented from opening, positioning a blocker on a first side of the gate latch such that movement of the latch member past the blocker is prevented in the selected barrier swing direction, securing the gate latch to a support surface, installing the gate barrier, moving the upper retainer in a direction toward the first side of the gate latch such that at least a portion of the upper retainer moves past the blocker, placing the latch member into the lower retainer, and moving the upper retainer to a position which prevents removal of the latch member from the lower retainer.

According to yet another aspect of the disclosure, an apparatus includes a gate barrier. The gate barrier has a first latch member positioned closer to a top of the gate than to a bottom of the gate and an upper gate latch configured to retain the first latch member to prevent the gate barrier from opening in a first direction. The upper gate latch includes a base and a lower retainer configured to retain the first latch member. The upper gate latch also includes an upper retainer configured to retain the first latch member within the lower retainer. The upper retainer is movable to selectively retain the first latch member in the gate latch and permit removal of the first latch member from the gate latch. The gate latch also includes a blocker arranged to prevent the first latch member from moving beyond the blocker in the first direction when the first latch member is removed from the lower retainer. The apparatus further includes a lower gate support configured to support a second latch member, the second latch member positioned closer to a bottom of the gate than to a top of the gate.

According to another aspect of the disclosure, an apparatus includes a hinge configured to be mounted to a first support surface, and a gate barrier configured to be pivotally mounted to the first support surface by the hinge. A gate latch is configured to be attached to a second support surface, the gate latch including a lower retainer and a movable upper retainer. A latch member is configured to be attached to the gate barrier and configured to be selectively retained by the gate latch. The apparatus also includes a blocker including a latch member blocker portion. When the hinge is mounted to the first support surface, and the gate barrier is pivotally mounted to the first support surface by the hinge, and the gate latch is attached to the second support surface, and the latch member is attached to the gate barrier, the lower retainer is configured to prevent the latch member from moving in a first gate barrier opening direction when the latch member is positioned within the lower retainer, and the lower retainer is configured to prevent the latch member from moving a second, different gate barrier opening direction when the latch member is positioned within the lower retainer. The upper retainer has a first upper retainer position in which the upper retainer prevents removal of the latch member from the lower retainer. The upper retainer has a second upper retainer position in which the upper retainer permits removal of the latch member from the lower retainer. The latch member blocker portion is arranged such that when the latch member is removed from the lower retainer, the latch member blocker portion prevents the latch member from moving from a first latch member position within gate latch to a second position outside of the gate latch so as to prevent the gate barrier from being pivotally opened in the first gate barrier opening direction. The upper retainer is configured to be movable from the first upper retainer position to the second upper retainer position by moving past the latch member blocker portion such that as the upper retainer moves past the latch member blocker portion, the latch member blocker portion is positioned between the upper retainer and the second support surface in a direction perpendicular to the second support surface.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

Non-limiting embodiments of the present disclosure will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the disclosure shown where illustration is not necessary to allow those of ordinary skill in the art to understand the disclosure. In the figures.

DETAILED DESCRIPTION

Figure 1:
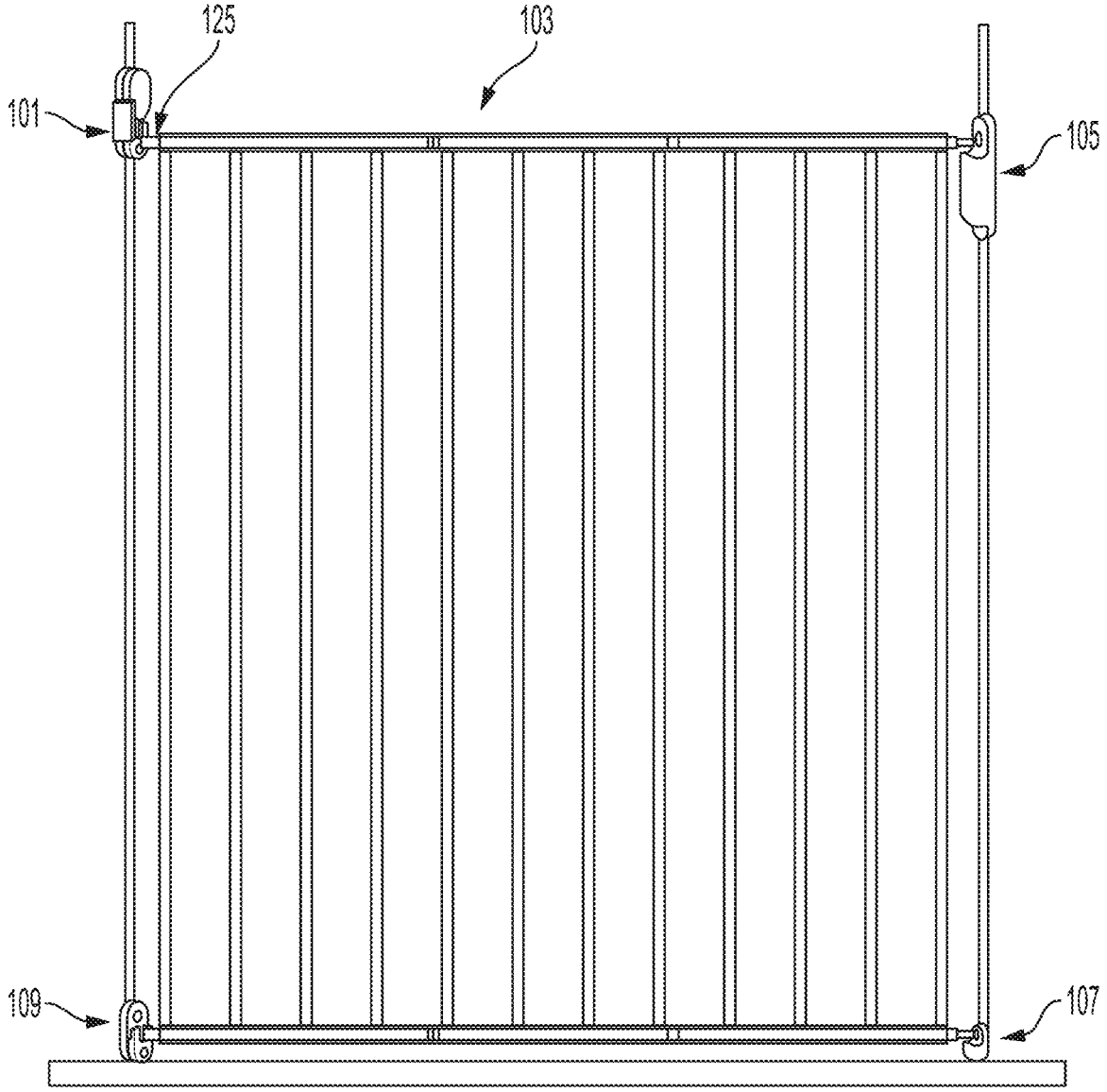
FIG. 1 shows a gate mounted to a wall with a gate latch assembly according to one embodiment.

Gates are used to help prevent children or pets from accessing certain areas. Generally, a gate has a gate barrier that can be moved by an adult. Some gate barriers swing when moving between an opened and a closed position. With swing gates, one side of the barrier is hingedly attached to the gate so that the gate swings open and closed, and the other side has an arrangement to secure the barrier in the closed position. On the securing side of a gate, a gate latch may secure a gate barrier in place by retaining a latch member that extends from the gate barrier. A gate latch may be in a retaining configuration or a non-retaining configuration. In the retaining configuration, that gate latch prevents the gate barrier from opening, while in a non-retaining configuration, the gate latch allows a user to open the gate barrier. Typically, when a gate latch is in a retaining position, the gate latch prevents a gate barrier from moving side-to-side, but may allow some minor upward movement.

Often, the securing side of the gate requires two or more distinct actions by the user to open the gate. For example, in the secured position, a latch member is held by a gate latch. To release the gate barrier, the user presses a button, squeezes a handle, or takes some other initial action, then releases the latch member from the latch. The user is then free to open the gate.

In some conventional gates, the gate latch is vertically mounted. In such gates, a rotatable retainer is used to selectively permit a latch member to be removed from a gate latch. The user rotates the retainer from a retaining position to a non-retaining position and is then able to lift the latch member out of the latch and then swing the gate open. Conversely, when the retainer is in the retaining position, the user is unable to lift the latch member out of the latch.

In some cases, gates are installed in a location where the user wants the gate to swing open only in one direction, for example when installed at the top or bottom of a staircase. Some conventional swing gates have a swing blocker which prevents the gate from swinging open in one direction by blocking the latch member.

Applicant has recognized that the conventional rotatable retainer arrangements and conventional swing blocker arrangements have not been usable together on a latch. Instead, conventional gates have the rotatable retainer on a latch at the top of a gate, and the blocker on a catch assembly at the bottom of the gate.

According to the present disclosure, a blocker and a movable retainer are provided on a latch. In this manner, the swing blocker is positionable at the top of the gate, which may provide various advantages. For example, the user typically pulls or pushes the gate at the top. When the swing blocker is also located at the gate top, the torque on the gate barrier applied during operation is reduced in comparison to conventional systems that contain a blocker on a lower gate latch member. Thus, the structural rigidity and longevity of the gate barrier and gate latch assembly can be improved.

Additionally, to an unfamiliar user, having the blocker at the top can provide visual feedback as to why the gate cannot open in one direction. When the blocker is at the bottom, an unfamiliar user may think the gate is just stuck and apply excessive force to try to open the gate barrier and overly torque the gate.

Moreover, Applicant has recognized the advantages that may be realized with a blocker that allows the movable upper retainer to move freely beyond a blocker. In such an embodiment, a user can easily operate the gate latch from either side of the gate, regardless of the configuration of the blocker. Such a configuration is desirable, as the configuration allows a user to more easily operate a gate barrier from the side of the blocker to allow, for example, a child or pet on the opposite side of the gate to pass beyond the gate barrier, towards the user.

To allow the retainer to be movable in both directions without being blocked by the blocker, according to the present disclosure, the blocker is positioned toward an edge of the latch assembly, and the retainer is spaced from a base of the latch assembly so that the retainer does not contact the blocker, yet a portion of the latch member, such as a latch member head, does hit the blocker if the latch member is moved in the blocked direction.

A reversible blocker can be helpful to allow a user to adapt a gate and gate latch system to a plurality of applications. For example, the blocker may be configured to block a gate barrier from moving in one direction in a first application. In turn, that same blocker may be reversed to block the same gate barrier from moving in a second direction opposite to the first direction.

According to embodiments of the present disclosure, a gate latch may contain a movable upper retainer for a latch member and a fixed lower retainer for a latch member. A gate latch may further contain a blocker to stop a gate barrier from swinging in one direction, even when the gate latch is in the non-retaining position.

According to embodiments of the present disclosure, the blocker may be configured to allow at least a portion of the upper retainer to move beyond the blocker, for example, when moving between the retaining and non-retaining positions. The blocker extends from a front-facing surface of the base towards a rear facing surface of the upper retainer by a distance which allows at least a portion of the upper retainer to clear the blocker when the upper retainer is moving between a retaining position and a non-retaining position. In some embodiments, the blocker is selectively positionable to prevent the gate barrier from opening in either a first direction or a second direction opposite to the first direction. Specifically, the blocker prevents a portion of the latch member from moving far enough in either a first direction or a second direction opposite to the first direction to allow the gate barrier to open.

According to another aspect of the present disclosure, a method is disclosed of installing a gate including selecting a direction in which a gate barrier is prevented from opening. In some embodiments, the method includes selecting a barrier swing direction in which the gate barrier will be prevented from opening. The method further includes positioning a blocker on a first side of the latch such that movement of the latch member past the blocker is prevented in the selected barrier swing direction. A user can, in turn, secure a gate latch to a support surface such as a wall, a banister, or any other suitable support surface. Then the user can install a gate barrier. In some embodiments, the length of the gate barrier is adjustable.

To operate the gate barrier, the user can move a movable upper retainer in either a first direction or a second direction opposite to the first direction. With the blocker in place, a user can also move the upper retainer in the direction of the blocker, such that at least a portion of the upper retainer moves past the blocker. To prevent the gate barrier from moving, the user can place the latch member into the groove of the lower latch member and move the upper retainer into a retaining position. In this configuration, the latch member is prevented from moving sufficiently to allow the gate barrier to open. To open the gate barrier, the user may selectively move the upper retainer into a non-retaining position. The user may then release the latch member from the lower retainer and open the gate barrier. In embodiments containing a blocker, the user will be unable to move the latch member beyond the blocker, preventing the user from opening the gate barrier in one direction, even when the upper retainer is in a non-retaining position.

Now turning to the figures, FIG. 1 shows an assembly comprising a gate latch 101 and a gate barrier 103. Gate barrier 103 attaches to a support surface, such as a wall, bannister, or any other suitable surface, via a pair of hinges 105 and 107. A latch support 109 assists gate latch 101 in holding gate barrier 103 in place when gate barrier 103 interfaces with gate latch 101. In some embodiments, the span of gate barrier 103 is adjustable.

In some embodiments, gate latch 101 prevents gate barrier 103 from opening in a first direction. Gate latch 101 contains an upper retainer 117 and a lower retainer 111, as shown in FIGS. 2-7. Upper retainer 117 and lower retainer 111 are each attached to a base 121 of gate latch 101. Lower retainer 111 contains a groove 115 to allow a latch member 125, attached to gate barrier 103, to interface with groove 115 on the lower retainer 111, as shown in FIG. 3. When gate latch 101 is in a retaining position, the movement of latch member 125 is restricted such that gate barrier 103 cannot be opened. The groove may have a depth that is greater than a height of the latch member such that the lower retainer is configured to prevent the latch member from moving in a gate barrier opening direction and out of the lower retainer when the latch member is positioned within the lower retainer.

In some embodiments, latch member 125 connects to an upper portion of gate barrier 103. Latch member 125 may fasten to gate barrier 103 via a threaded screw, a locking nut, or any other suitable fastener. In some embodiments, latch member 125 is a bolt. In certain embodiments, latch member 125 may be configured as a pin, cantilever, or any other suitable configuration. Latch member 125 may be made of metal, plastic, or any other suitable material.

Figure 2:
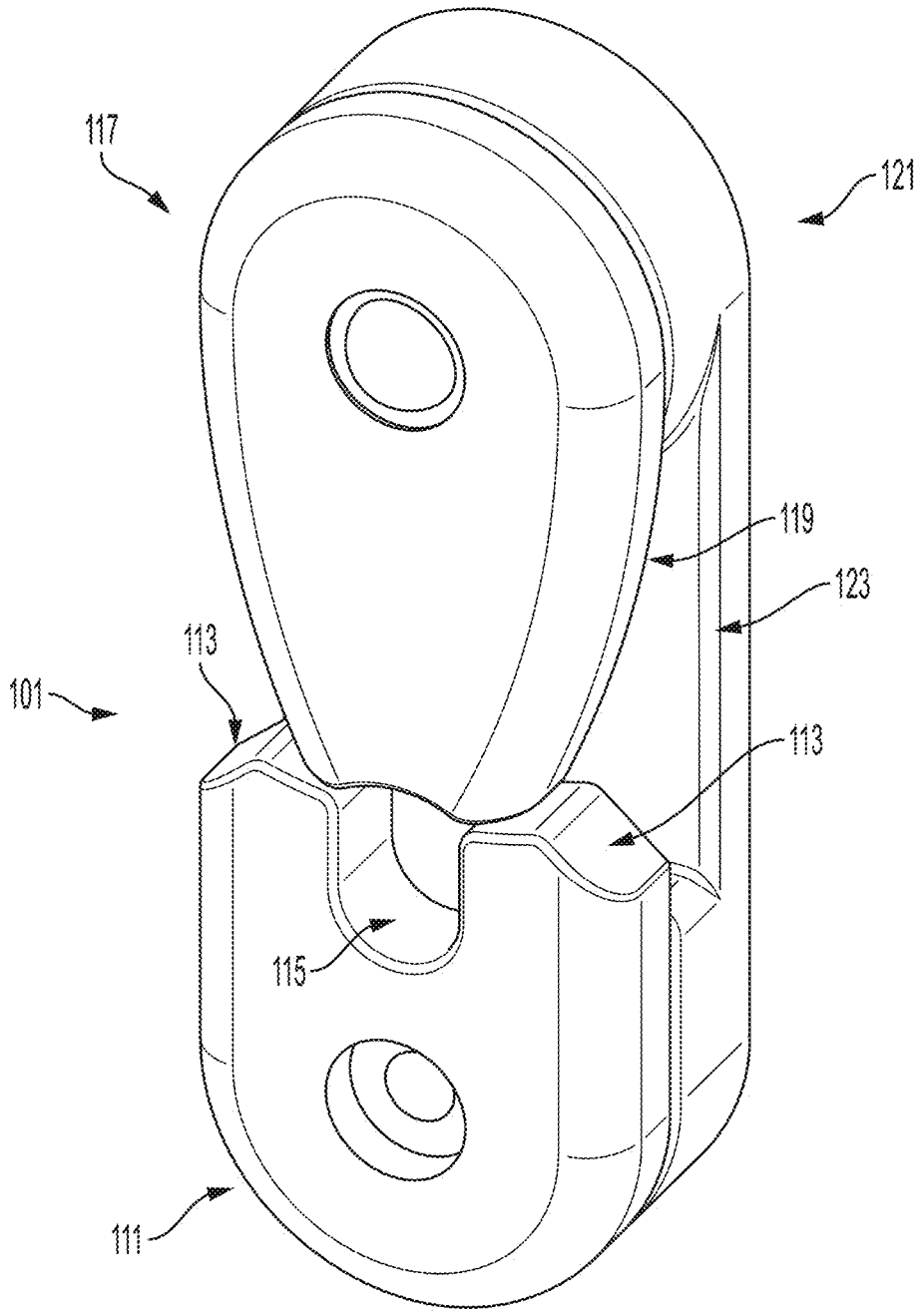
FIG. 2 is perspective view of a gate latch without an engaged latch member according to one embodiment.
Figure 3:
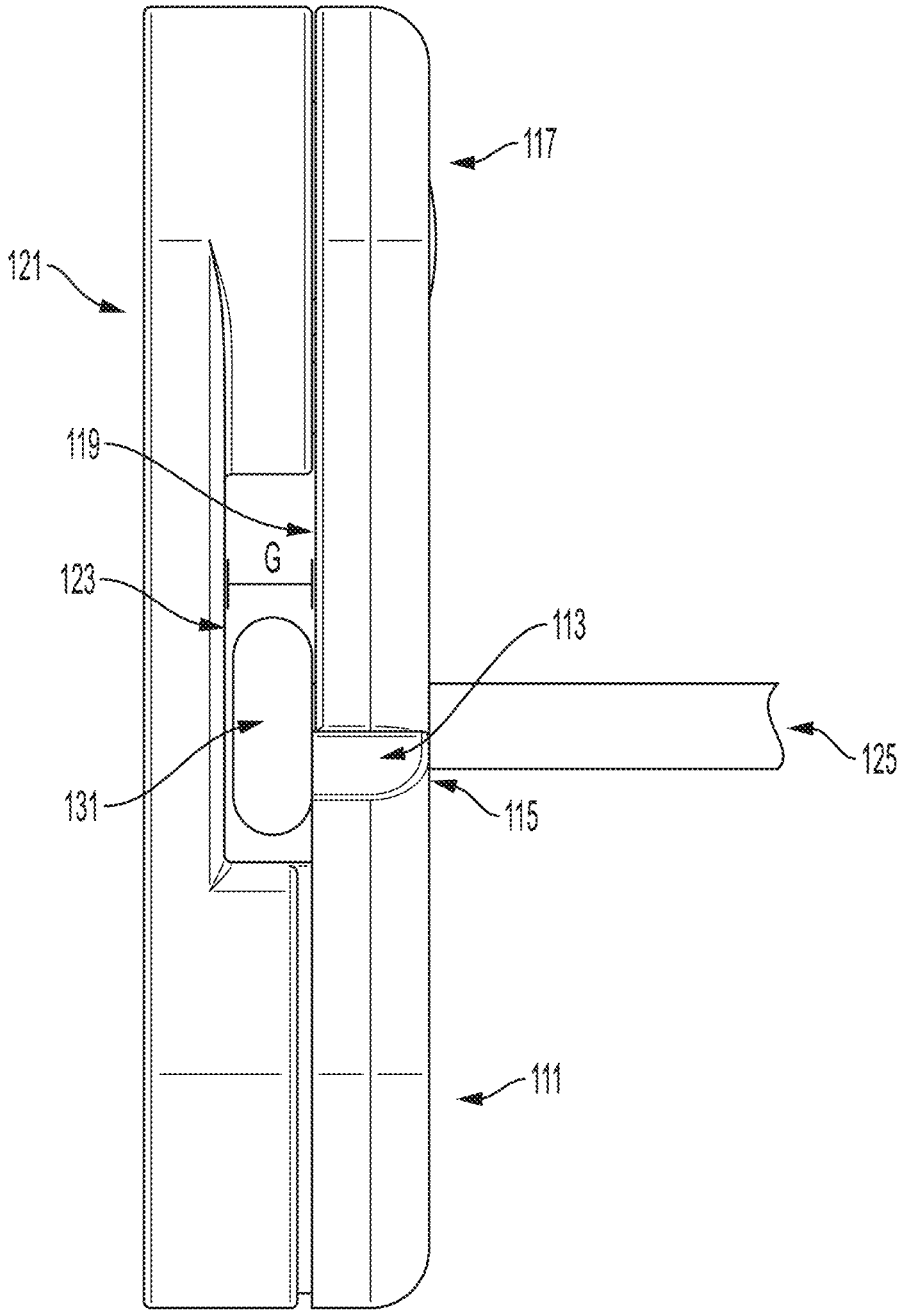
FIG. 3 is a side view of a gate latch with a latch member engaged according to one embodiment.

FIG. 2 shows gate latch 101 without the latch member engaged. FIG. 3 is a left side view of gate latch 101 with latch member 125 engaged with gate latch 101. In this embodiment, lower latch member 111 is configured with groove 115, which is capable of interfacing with latch member 125. In the configuration shown in FIG. 3, upper retainer 117 is in the retaining position. Latch member 125, which attaches to an upper portion of gate barrier 103, is engaged with groove 115 of lower retainer 111. Upper retainer 117 restricts latch member 125 from moving sufficiently upwardly to disengage from groove 115. Groove 115 restricts the movement of latch member 125 to either side.

According to one aspect of the present disclosure, gate latch 103 provides a gap of distance G between a front-facing surface 123 of base 121 and a rear-facing surface 119 of upper retainer 117. When the upper retainer is rotated to a non-retaining position, a user may open gate barrier 103 by lifting latch member 125 out of groove 115 and moving a latch member head 131 (or other portion of the latch member) laterally past the sides of the base.

In some embodiments, base 121 is configured to connect to upper retainer 117 and lower retainer 111. Base 121 may attach to upper retainer 117 and lower retainer 111 using screws, nails, or any other suitable fastener. Lower retainer 111 can be attached to base 121 with an adhesive, such as epoxy or any other suitable adhesive. In turn, base 121 may be fastened to a wall, a bannister, or any other suitable support surface. Base 121 may be fastened to a suitable support surface using a screw, nail, or any other suitable fastener.

In some embodiments, lower retainer 111 is configured to hold latch member 125 in place when upper retainer 117 is in a retaining position. Lower retainer 111 may hold latch member 125 in groove 115. In embodiments where the gate latch is vertically mounted, such as in FIGS. 1-7, groove 115 is vertical. Groove 115 may be a "U" shape or any other suitable shape. Lower retainer 111 may be made out of metal, plastic, or any other suitable material.

In further embodiments, lower retainer 111 also has angled surfaces 113. For example, when gate latch 101 is mounted to a vertical surface, a first surface of the lower latch member may be angled downwardly away from the latch relative to horizontal. Such a configuration is desirable as the configuration easily allows a user to insert latch member 125 into groove 115. Specifically, as the user closes the gate barrier, the latch member contacts one of the angled surfaces 113, which guides the latch member upwardly toward the groove of the lower retainer. Additionally, in yet further embodiments, lower retainer 111 has a second surface 114 angled downwardly away from the gate latch relative to horizontal. This surface 114 further guides the latch member into the groove of the lower retainer. Surface 114 also may facilitate removal of the latch member from the latch when moving the latch member sideways away from the groove. In such a situation, angled surface 114 may help guide the latch member upwardly. Angled surfaces 113 may be symmetrical on each side of lower retainer 111, though symmetry is not required in this respect.

Figure 4:
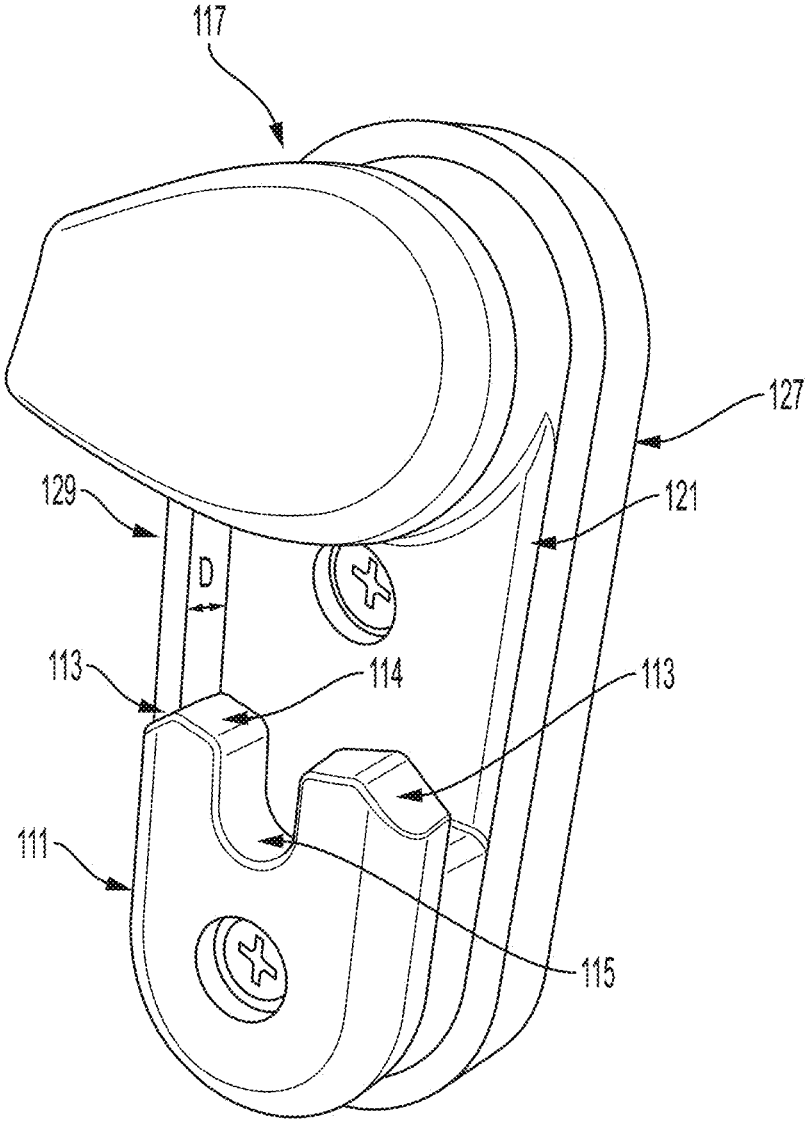
FIG. 4 shows a gate latch with a blocker and a rotated upper retainer according to one embodiment.
Figure 5:
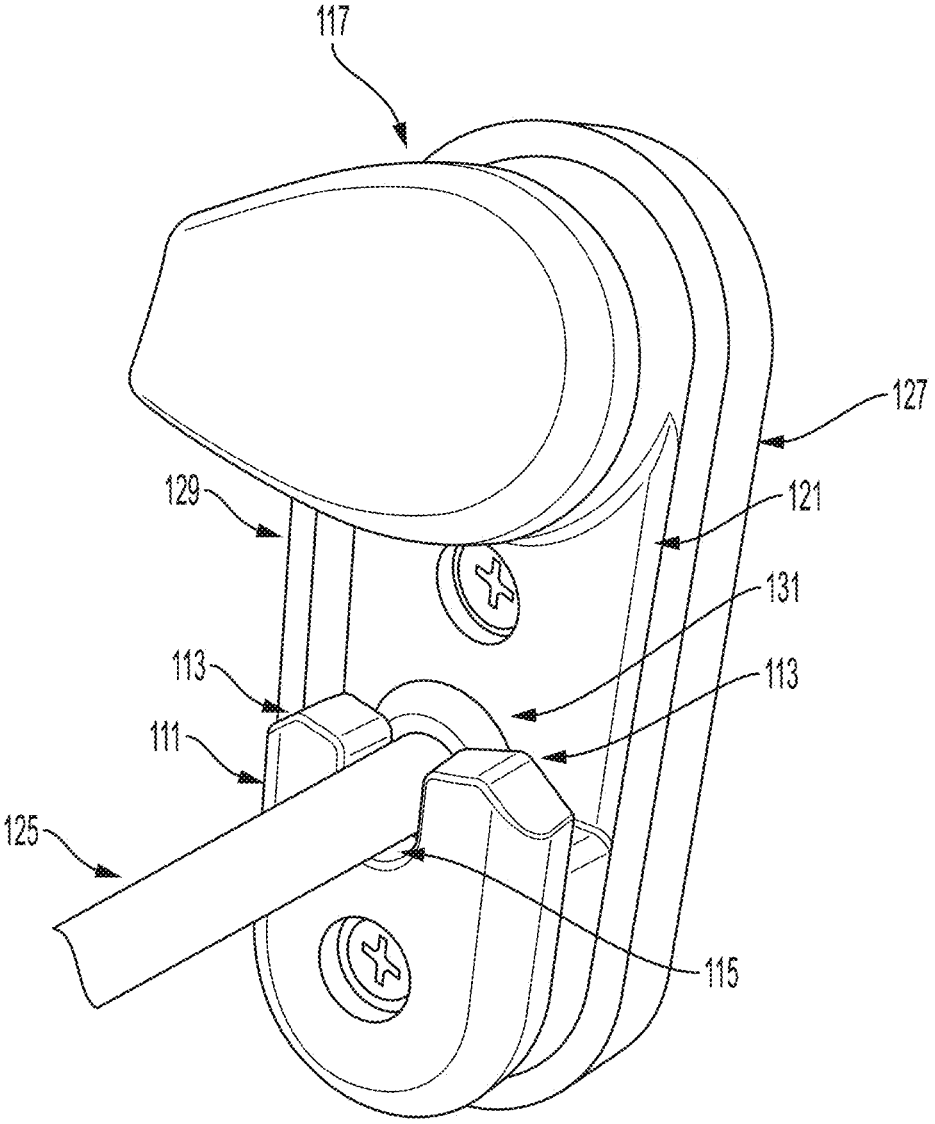
FIG. 5 shows the gate latch of FIG. 4 with a latch member engaged with the gate latch according to one embodiment.

FIG. 4 shows a perspective view of an embodiment of gate latch 101 with single sided blocker 127 arranged with a blocking portion 129 on the left side of gate latch 101 to block movement of the gate toward the left. FIG. 5 shows a perspective view of the same embodiment of gate latch 101 with a single sided-blocker 127, wherein latch member 125 is engaged with groove 115. In this embodiment, blocking portion 129 of blocker 127 covers the gap of distance G in one direction, or extends from the base by a distance which extends at least partway into the gap. Accordingly, blocking portion 129 of blocker 127 restricts the movement of latch member 125 in one direction by preventing latch member head 131 from moving beyond the blocker, regardless of whether upper retainer 117 is in the retaining or non-retaining position. In the illustrated configuration, upper retainer 117 is in a non-retaining position. Moreover, portion 129 of blocker 127 covers an area within the gap of distance G without obstructing the movement of upper retainer 117. Thus, a user can move upper retainer 117, or a portion thereof, freely in any suitable direction, while blocker 127 is affixed to gate latch 101. For example, in some embodiments, portion 129 of blocker 127 extends a distance D beyond a front-facing surface of the base, and the gap of distance G may be larger than the distance D. In some embodiments, base 121 nests within a portion of blocker 127. A screw, nail, or other suitable fastener may affix gate latch 101 and blocker 127 to a wall, bannister, or any other suitable surface simultaneously. The screw visible in FIGS. 4-7 is shown only partially inserted into a bannister. When the gate latch is fully attached, the screw head typically does not protrude from base 121.

The gap may have a distance G of any suitable value. For example, in various embodiments, distance G may be 4 mm or at least 4 mm, 4.5 mm or at least 4.5 mm, 5 mm or at least 5 mm, 5.5 mm or at least 5.5 mm, or any other suitable value. Further, in various embodiments, distance G may be less than 7 mm, less than 6.5 mm, less than 6 mm, or any other suitable value. Combinations of the above referenced ranges are also contemplated. For example, distance G may be between 4 mm and 7 mm inclusive, between 4.5 mm and 6.5 mm inclusive, or between 5 mm and 6 mm inclusive. Distance G may be other suitable values or ranges, depending on the application.

Distance D may be a distance of any suitable value. For example, in various embodiments, distance D may be 3.5 mm or at least 3.5 mm, 4 mm or at least 4 mm, 4.5 mm or at least 4.5 mm, 5 mm or at least 5 mm, or any other suitable value. Further, in various embodiments, distance D may be less than 6.5 mm, less than 6 mm, less than 5.5 mm, or any other suitable value. Combinations of the above referenced ranges are also contemplated. For example, distance D may be between 3.5 mm and 6.5 mm inclusive, between 4 mm and 6 mm inclusive, or between 4.5 mm and 5.5 mm inclusive. Distance D may be other suitable values or ranges, depending on the application.

In some embodiments, upper retainer 117 may be configured to restrict the movement of latch member 125 such that gate barrier 103 cannot open. Upper retainer 117 can be selectively movable between a variety of positions, such as a retaining position and a non-retaining position. In embodiments where gate latch 101 is vertically mounted, upper retainer 117 restricts the movement of the latch member in the vertical direction when upper retainer 117 is in the retaining position, as shown in FIG. 3. When a user moves upper retainer 117 to the non-retaining position, the user is free to lift latch member 125 out of groove 115 of lower retainer 111 to open gate barrier 103.

In some embodiments, including the embodiments shown in FIGS. 4-5, upper retainer 117 is rotatable. In such embodiments, upper retainer 117 can be rotated selectively to retain or permit removal of latch member 125. Upper retainer 117 may be rotated in both a first direction and a second direction opposite to the first direction.

Upper retainer 117 may include a spring to bias upper retainer 117 to a home position, where upper retainer 117 blocks latch member 125 from being removed from grove 115. Moreover, when upper retainer 117 is in the retaining position, the spring may bias the upper retainer to remain in the retaining position. The spring may be configured to require a threshold torque to overcome the spring torque. Instead of, or in addition to a spring, any suitable biasing member may be used. Upper retainer 117 may be made out of metal, plastic, or any other suitable material. Upper retainer 117 may be circular, oval shaped, tear drop shaped, or any other suitable shape.

Figure 6:
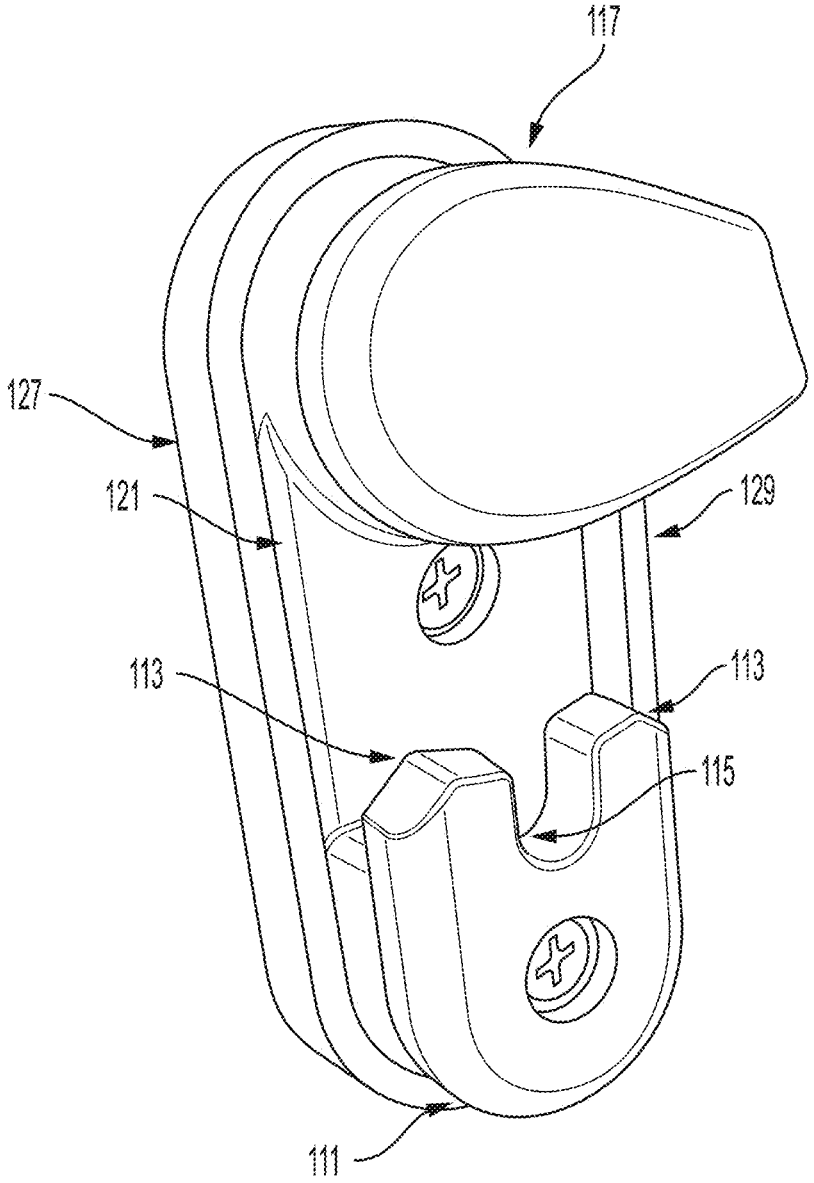
FIG. 6 shows the gate latch of FIG. 4 with the blocker on an opposite side as compared to FIG. 4, and the upper retainer rotated in the opposite direction according to one embodiment.
Figure 7:
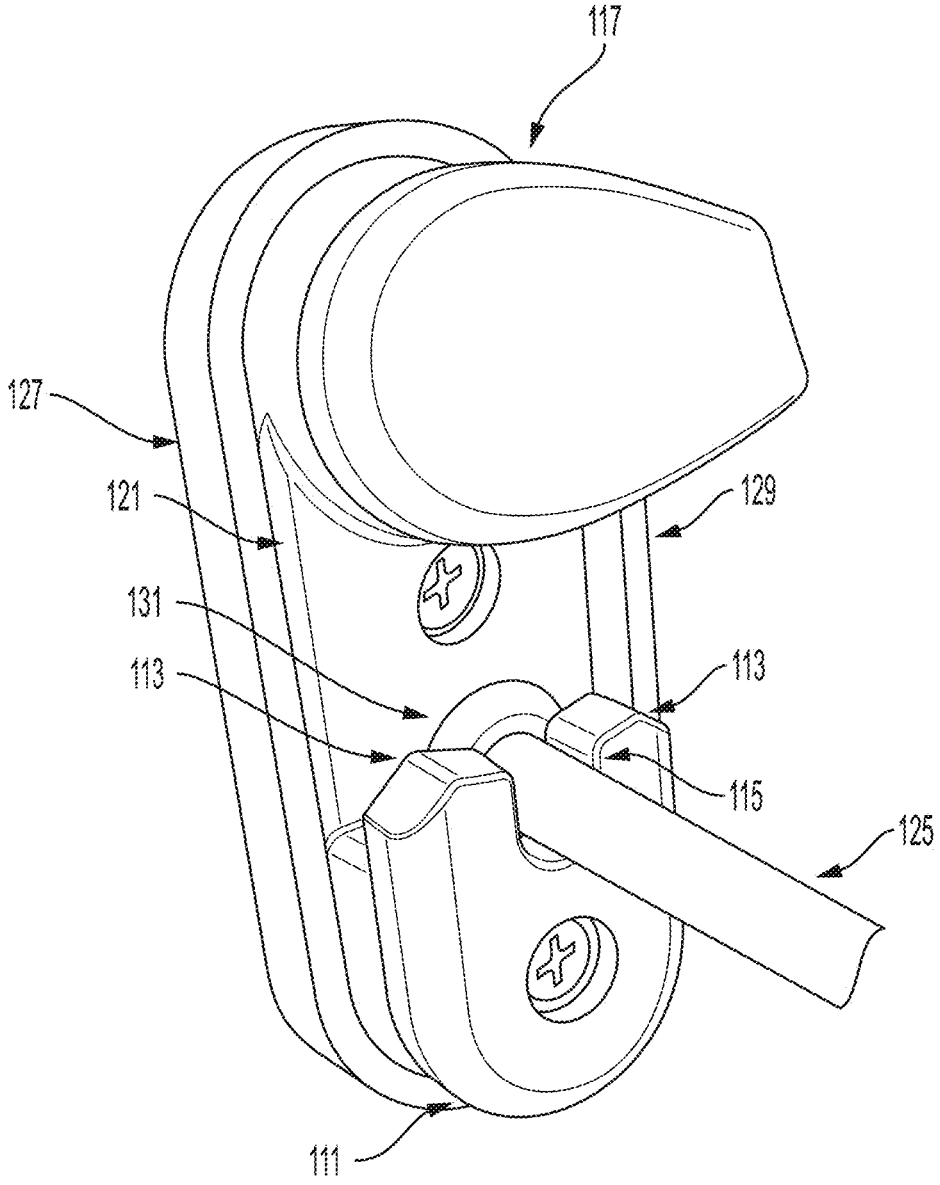
FIG. 7 shows the gate of FIG. 6 with a latch member engaged with the latch according to one embodiment.

As shown in FIGS. 4-7, gate latch 101 may also contain blocker 127. Blocker 127 serves to restrict the movement of latch member 125 such that gate barrier 103 cannot open in a first direction, even when upper retainer 117 is in a non-retaining position. With blocker 127 in place, if a user tries to open gate barrier 103 in the direction of the blocker, head 131 of latch member 125 will contact a portion 129 of blocker 127, preventing latch member 125 from moving beyond blocker 127. Thus blocker 127 may prevent the user opening gate barrier 103 in a first direction by having blocker portion 129 act as a swing blocker. Blocker 127 may also be configured to prevent a user from opening gate barrier 103 in a second direction opposite to the first direction, as shown in FIGS. 6-7.

In some embodiments, base 121 may be attached to blocker 127. In turn, blocker 127 and base 121 may be simultaneously attached to a support surface such as a wall, a bannister, or any other suitable support surface. Blocker 127 can be made of metal, plastic, or any other suitable material.

As can be seen in FIG. 5, groove 115 may have a vertical depth that is greater than a vertical height of the portion of the latch member that is held by groove 115 such that the lower retainer is configured to prevent the latch member from moving in a gate barrier opening direction and out of the lower retainer when the latch member is positioned within the lower retainer.

FIG. 6 shows a perspective view of an embodiment of gate latch 101 with blocker portion 129 arranged on the right side of gate latch 101 to block movement of the gate toward the right. FIG. 7 shows a perspective view of the same embodiment of gate latch 101 with blocker 127, with latch member 125 engaged with groove 115. Blocker 127 is reversible such that a user can configure blocker 127 to restrict the movement of latch member 125 in either a first or alternatively a second direction. In the illustrated configuration, blocker 127 is configured to restrict latch member 125 from moving far enough to the right to allow the gate to open toward the right, regardless of the position of upper retainer 117. The same blocker 127 may also be reconfigured to restrict latch member 125 from moving far enough to the left to permit opening of gate 101 toward the left, regardless of the position of upper retainer 117, as shown in FIG. 5.

As shown in FIGS. 4-7, upper retainer 117 can be configured to rotate. In certain embodiments, upper retainer 117 can rotate such that at least a portion of upper retainer 117 clears portion 129 of blocker 127. Moreover, a portion of upper retainer 117 can clear portion 129 of blocker 127 when rotated regardless of whether blocker 127 is configured to prevent latch member head 131 from moving beyond portion 129 of blocker 127 in a first direction, as in FIGS. 4-5, or beyond portion 129 of blocker 127 in a second direction opposite to the first direction, as in FIGS. 6-7. As can be seen in FIGS. 4-7, as upper retainer 117 moves beyond portion 129 of blocker 127, the rear-facing surface of upper retainer 117 faces blocker portion 129. As also can be seen in FIGS. 4-7, blocker portion 129 is positioned between upper retainer 117 and the wall or other support surface in a direction perpendicular to the support surface. In this manner, upper retainer 117 is positioned in front of blocker portion 129 when being moved to the non-retaining position.

Figure 8:
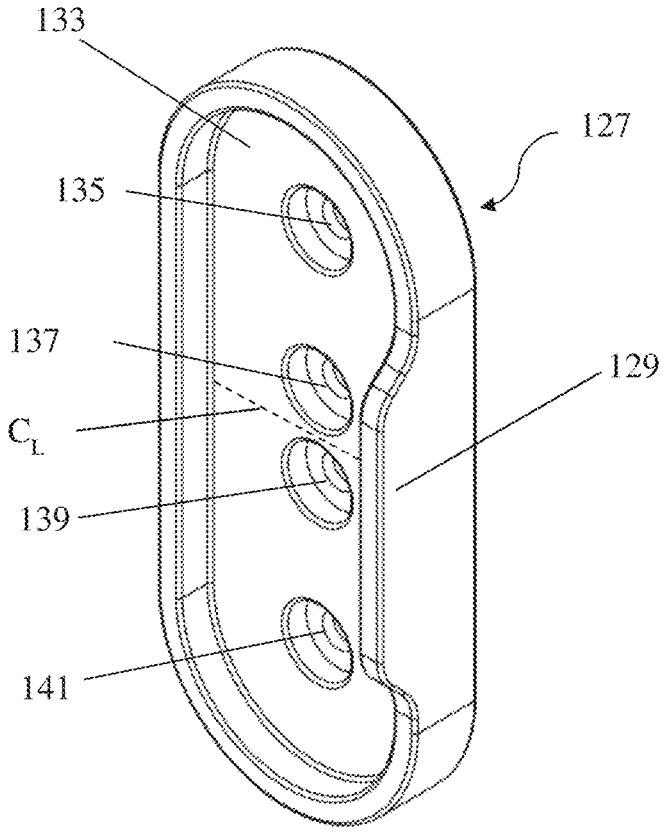
FIG. 8 shows a swing blocker according to one embodiment.

FIG. 8 shows an exemplary embodiment of blocker 127, to which base 121 may be attached. Base 121 may be attached within a recess 133 of blocker 127 and portion 129 may act as a swing blocker. In some embodiments, recess 133 is shaped in a manner complementary to the shape of base 121 so as to accommodate base 121. In some embodiments, including the embodiment of FIG. 8, base 121 may be attached to blocker 127 via one or more fasteners (e.g., screws, pins, nails, etc.). Accordingly, blocker 127 may include one or more corresponding openings, such as openings 135, 137, 139, 141 to receive the one or more fasteners.

In some embodiments, for example as shown in FIG. 7, base 121 may be arranged to be fixed to blocker 127 via two openings (e.g., openings 137, 141). In such an embodiment, blocker 127 may be capable of being inverted to an opposite orientation. For example, blocker 127 may be capable of being reoriented between a first configuration where portion 129 of blocker 127 prevents latch member 125 from moving in a first direction (e.g., toward the right as in FIG. 7) and a second configuration where portion 129 of blocker 127 prevents latch member 125 from moving in a second direction opposite the first direction (e.g., toward the left as in FIG. 5). Openings 135, 137, 139, 141 may be positioned to accommodate such configurations. For example, in the first configuration, base 121 may be fixed to blocker 127 by passing fasteners through openings 137, 141, whereas in the second configuration, fasteners may be passed through openings 135, 139. Opening 137 and opening 139 may be equidistant from a horizontal centerline CL of blocker 127. Similarly, opening 135 and opening 139 may be equidistant from horizontal center line CL.

Portion 129 of blocker 127 may be integrally formed with blocker 127, or in some embodiments, portion 129 may be formed separately and attached to blocker 127.

Other attachment configurations are also contemplated. For example, in some embodiments, base 121 may be formed with blocker 127. Base 121 may be fixed to blocker 127 in any suitable manner, depending on the application.

According to an alternative embodiment, instead of rotating, an upper retainer may move from a retaining position to a non-retaining position by sliding. Any suitable mode of movement may be used.

Figure 9:
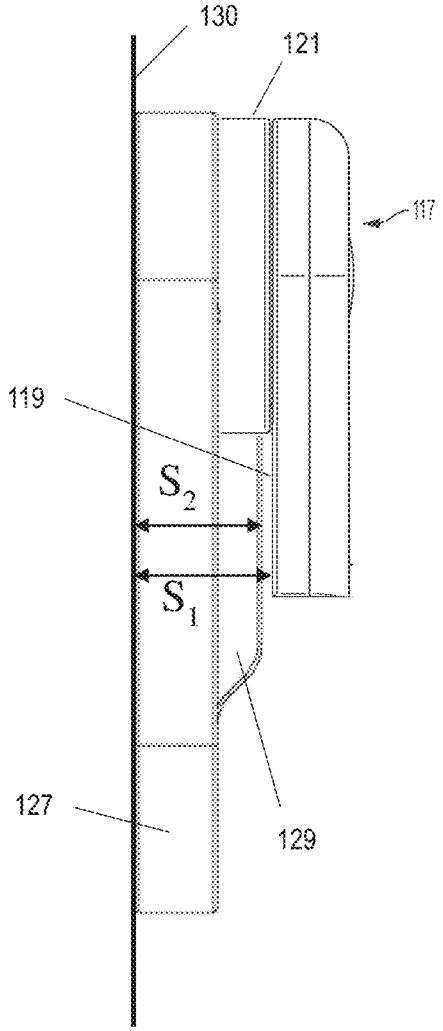
FIG. 9 is a side view of a blocker and a portion of a gate latch mounted to a support surface.

FIG. 9 is a side view of base 121 mounted to blocker 127 and a support surface such as a wall 130. The lower retainer is not shown in FIG. 9 so that blocker portion 129 is better visible for purposes of illustration. Blocker portion 129 is positioned on the far side of the blocker 127 in FIG. 9 and acts to block a latch member from moving such that the gate is prevented from opening in the direction of blocker portion 129. In this manner, blocker portion 129 acts as a latch member blocker portion.

Upper retainer 117 is pivotable, and rear-facing surface 119 of upper retainer 117 is spaced from wall 130 by a first distance $S_1$. A forwardmost portion of blocker portion 129 is positioned a second distance $S_2$ from the wall 130. Distance $S_1$ is greater than distance $S_2$ such that upper retainer can move past blocker portion 129 when the upper retainer is pivoted toward a non-retaining position in the direction of blocker portion 129 (counterclockwise in the configuration shown in FIG. 9.) When the upper retainer is pivoted such that blocker portion 129 is positioned between the wall and the upper retainer in a direction perpendicular to the wall, the forwardmost extent of the blocker portion does not reach the upper retainer, thereby permitting the upper retainer to move past the blocker portion with the blocker portion positioned between the upper retainer and the wall.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the disclosure may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An apparatus comprising:

a gate latch configured to prevent a gate barrier from opening in a first direction, the gate latch comprising:

a base;

an upper retainer to retain a latch member, the upper retainer being movable to selectively retain the latch member in the gate latch and permit removal of the latch member from the gate latch;

a lower retainer to retain the latch member and prevent movement of the latch member in the first direction or a second opposite direction when the latch member is received in the lower retainer; and a blocker arranged to prevent the latch member from moving beyond the blocker in the first direction when the latch member is removed from the lower retainer;

wherein the base has a front-facing surface, and the upper retainer has a rear-facing surface which faces the front-facing surface of the base, the front-facing surface of the base being spaced from the rear-facing surface of the upper retainer by a first distance;

wherein the blocker extends forwardly beyond the front-facing surface of the base by a second distance which is less than or equal to the first distance; and wherein the blocker is selectively positionable to prevent the latch member from moving in the first direction, and the blocker is selectively positionable to prevent the latch member from moving in the second direction.

2. The apparatus of claim 1, wherein the movable upper retainer for the latch member is rotatable to selectively retain the latch member in the gate latch and permit removal of the latch member from the gate latch.

3. The apparatus of claim 1, wherein the blocker includes a blocker portion and the upper retainer is configured to be positioned in front of the blocker portion as the upper retainer is moved away from a latch member retaining position such that the blocker portion is positioned between the upper retainer and the front-facing surface in a direction perpendicular to the front-facing surface.

4. The apparatus of claim 1, wherein the lower retainer for the latch member has a groove arranged to hold the latch member, the groove is vertical when the latch member is mounted to a vertical surface, and the groove has a vertical depth that is greater than a vertical height of the latch member.

5. An apparatus comprising:

a latch member;

a gate latch configured to prevent a gate barrier from opening in a first direction by retaining the latch member, the gate latch comprising:

a base;

an upper retainer movable to selectively retain the latch member, the upper retainer having a rear-facing surface, wherein the upper retainer is rotatable in a first rotation direction and in a second rotation direction opposite to the first rotation direction;

a lower retainer for retaining the latch member and preventing movement of the latch member in the first direction or a second opposite direction when the latch member is received in the lower retainer; and a blocker arranged to prevent the latch member from moving beyond the blocker in the first direction, the blocker including a blocker portion arranged to be contacted by the latch member;

wherein the blocker is positioned to permit at least a portion of the upper retainer to move beyond the blocker portion with the rear-facing surface of the upper retainer facing the blocker portion, and wherein the blocker is selectively positionable to prevent the latch member from moving in the first direction, and the blocker is selectively positionable to prevent the latch member from moving in the second direction.

6. The apparatus of claim 5, wherein the movable upper retainer for the latch member is rotatable to selectively retain the latch member in the gate latch and permit removal of the latch member from the gate latch.

7. The apparatus of claim 5, wherein the upper retainer is rotatable from a first side of the blocker in which the upper retainer is in a latch member retaining position to a second side of the blocker beyond the blocker in which the upper retainer is in a position which allows the latch member to be removed from the lower retainer.

8. The apparatus of claim 5, wherein the lower retainer for the latch member has a groove arranged to hold the latch member.

9. The apparatus of claim 8, wherein the groove is vertical when the latch member is mounted to a vertical surface.

10. The apparatus of claim 5, wherein the lower retainer for the latch member has a groove arranged to hold the latch member, and the groove has a vertical depth that is greater than a vertical height of the latch member.

11. The apparatus of claim 5, wherein the upper retainer is configured to be positioned in front of the blocker portion as the upper retainer is moved away from a latch member retaining position such that the blocker portion is positioned between the upper retainer and a support surface in a direction perpendicular to the support surface.

12. An apparatus comprising:

a hinge configured to be mounted to a first support surface;

a gate barrier configured to be pivotally mounted to the first support surface by the hinge;

a gate latch configured to be attached to a second support surface, the gate latch including a lower retainer and a movable upper retainer;

a latch member configured to be attached to the gate barrier and configured to be selectively retained by the gate latch; and a blocker including a latch member blocker portion;

wherein when the hinge is mounted to the first support surface, and the gate barrier is pivotally mounted to the first support surface by the hinge, and the gate latch is attached to the second support surface, and the latch member is attached to the gate barrier:

the lower retainer is configured to prevent the latch member from moving in a first gate barrier opening direction when the latch member is positioned within the lower retainer, and the lower retainer is configured to prevent the latch member from moving a second, different gate barrier opening direction when the latch member is positioned within the lower retainer;

the upper retainer has a first upper retainer position in which the upper retainer prevents removal of the latch member from the lower retainer;

the upper retainer has a second upper retainer position in which the upper retainer permits removal of the latch member from the lower retainer;

the latch member blocker portion is arranged such that when the latch member is removed from the lower retainer, the latch member blocker portion prevents the latch member from moving from a first latch member position within the gate latch to a second position outside of the gate latch so as to prevent the gate barrier from being pivotally opened in the first gate barrier opening direction; and the upper retainer is configured to be movable from the first upper retainer position to the second upper retainer position by moving past the latch member blocker portion such that as the upper retainer moves past the latch member blocker portion, the latch member blocker portion is positioned between the upper retainer and the second support surface in a direction perpendicular to the second support surface, wherein the blocker is selectively positionable on either a first lateral side of the upper retainer or a second lateral side of the upper retainer.

13. The apparatus of claim 12, wherein the lower retainer comprises a groove with a vertical depth that is greater than a vertical height of the latch member.

14. The apparatus of claim 12, wherein the latch member includes a head configured to contact the latch member blocker portion when the latch member is moved toward the latch member blocker portion.

15. The apparatus of claim 12, wherein the movable upper retainer comprises a pivotable upper retainer, and the upper retainer is configured to be pivotable from the first upper retainer position to the second upper retainer position by pivoting past the blocker.

16. The apparatus of claim 12, wherein the upper retainer is configured such that as the upper retainer pivots past the latch member blocker portion, a rear-facing surface of the upper retainer is positioned a first distance from the second support surface, and the latch member blocker portion is positioned a second distance from the second support surface, and the first distance is greater than the second distance.

* * * * *